US011471992B2

(12) United States Patent
Zhang et al.

(10) Patent No.: US 11,471,992 B2
(45) Date of Patent: Oct. 18, 2022

(54) MULTI-FUNCTIONAL WHEEL DEBURRING DEVICE

(71) Applicant: CITIC Dicastal CO., LTD., Hebei (CN)

(72) Inventors: Yacong Zhang, Qinhuangdao (CN); Bowen Xue, Qinhuangdao (CN); Hongbao Wang, Qinhuangdao (CN); Jiandong Guo, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 690 days.

(21) Appl. No.: 16/504,081

(22) Filed: Jul. 5, 2019

(65) Prior Publication Data

US 2020/0147743 A1 May 14, 2020

(30) Foreign Application Priority Data

Nov. 12, 2018 (CN) ..... 201811339287.5

(51) Int. Cl.

| | |
|---|---|
| ***B24B 41/06*** | (2012.01) |
| ***B24B 47/12*** | (2006.01) |
| ***B24B 47/20*** | (2006.01) |
| ***B24B 29/00*** | (2006.01) |
| ***B24B 5/44*** | (2006.01) |
| ***B24B 9/04*** | (2006.01) |

(52) U.S. Cl.

CPC ..... *B24B 9/04* (2013.01); *B24B 5/44* (2013.01); *B24B 29/005* (2013.01); *B24B 41/06* (2013.01); *B24B 47/12* (2013.01); *B24B 47/20* (2013.01)

(58) Field of Classification Search

CPC .. B24B 5/06; B24B 5/065; B24B 5/08; B24B 5/40; B24B 5/44; B24B 5/355; B24B 9/007; B24B 9/00; B24B 9/005; B24B 9/04; B24B 29/005; B24B 29/04; B24B 27/0076; B24B 27/0069; B24B 41/067; B24B 41/061; B24B 41/065; B24B 41/066; B24B 41/02; B24B 41/12; B24B 41/005; B24B 47/12; B24B 47/20; B24B 55/00; B24D 13/145; B23D 79/04; A46B 13/008; A46B 13/02; B08B 1/04

USPC .... 451/146, 180, 254, 258, 290; 157/14, 16, 157/18, 21

See application file for complete search history.

(56) References Cited

U.S. PATENT DOCUMENTS

| | | | | |
|---|---|---|---|---|
| 9,889,534 | B2 * | 2/2018 | Xue | B60C 29/02 |
| 10,040,433 | B1 * | 8/2018 | Xue | B60S 3/06 |
| 10,335,868 | B2 * | 7/2019 | Liu | B23B 5/163 |
| 2016/0288282 | A1 * | 10/2016 | Liu | B60B 27/00 |

(Continued)

FOREIGN PATENT DOCUMENTS

| | | |
|---|---|---|
| CN | 108340233 A | 7/2018 |
| CN | 207606614 U | 7/2018 |

OTHER PUBLICATIONS

Supplementary European Search Report in the European application No. 19205994.7, dated May 25, 2020.

*Primary Examiner* — Joel D Crandall
*Assistant Examiner* — Makena S Markman
(74) *Attorney, Agent, or Firm* — Syncoda LLC; Feng Ma

(57) ABSTRACT

A multi-functional wheel deburring device is capable of removing burrs at the center hole, the flange weight reducing socket, the spoke back cavity weight reducing socket and the spoke edge of the wheel during the use.

1 Claim, 5 Drawing Sheets

(56) References Cited

U.S. PATENT DOCUMENTS

2016/0311215 A1* 10/2016 Xue ..... B60C 13/00
2019/0291235 A1 9/2019 Xue et al.

* cited by examiner

MULTI-FUNCTIONAL WHEEL DEBURRING DEVICE

CROSS-REFERENCE TO RELATED APPLICATIONS

The present application claims benefit of Chinese Application No. 201811339287.5, filed on Nov. 12, 2018, the contents of which are hereby incorporated by reference in its entirety.

BACKGROUND

During the machining production of the wheel, a lot of burrs are inevitably generated in the center hole, the flange weight reducing socket, the spoke back cavity weight reducing socket and the spoke edge of the wheel. If these burrs are not removed timely, the subsequent coating effect will be seriously affected, thus making the wheel fail in advance due to corrosion during the driving process. In order to effectively remove the burrs of the wheel back cavity, a burr-brushing type device is generally selected. There is currently no deburring device which can well handle the burrs of the above parts of the wheel in the industry.

SUMMARY

The present disclosure relates to a deburring device, in particular, to a multi-functional wheel deburring device.

An object of the present disclosure is to provide a multi-functional wheel deburring device, which is capable of removing burrs at the center hole, the flange weight reducing socket, the spoke back cavity weight reducing socket and the spoke edge of the wheel during the use.

In order to achieve the above objective, the technical solution of the present disclosure is that: a multi-functional wheel deburring device is composed of a frame, lower guide posts, a lower servo motor I, lower guide sleeves, a belt pulley I, a synchronous belt I, a lower fixing plate I, a belt pulley II, a lower lifting plate, a lower shaft I, a lower bearing seat I, a lower fixing plate II, a lower guide rail I, a servo electric cylinder I, a lower sliding plate I, a lower servo motor II, a lower vertical plate I, a lower fixing plate III, lower guide rails II, lower racks, a lower gear, lower sliding plates II, a lower vertical plate II, a lower servo motor III, a lower fixing plate IV, a lower shaft II, a lower bearing seat II, a lower servo motor IV, a belt pulley III, a synchronous belt II, lower arms, a torsion spring, a belt pulley IV, a belt pulley V, a synchronous belt III, upper arms, lower vertical brushes, a rotating shaft I, a belt pulley VI, a rotating shaft II, an upper cylinder, an upper fixing plate I, an upper gear, upper racks, an upper guide rail I, a left sliding plate, a left vertical plate, a servo electric cylinder II, an upper guide rail II, a left lifting arm, a left bearing seat, a left shaft, a left clamping jaw, a right clamping jaw, a right shaft, a right bearing seat, an upper servo motor I, a right lifting arm, an upper guide rail III, a right vertical plate, a servo electric cylinder III, a right sliding plate, an upper vertical brush, an upper servo motor II, an upper fixing plate II, an upper shaft I, an upper bearing seat I, an upper servo motor III, an upper rotating plate, an upper shaft II, an upper bearing seat II, an upper servo motor IV, an upper vertical plate, an upper servo motor V, an upper shaft III, an upper bearing seat III, a conical brush, an upper sliding plate, an upper guide rail IV, an upper lifting plate, an upper guide post, an upper guide sleeve, a servo electric cylinder IV, a servo electric cylinder V, a servo electric cylinder VI, and servo electric cylinders VII.

The lower lifting driving system includes: four lower guide sleeves, fixed to the lower part of the lower fixing plate I; four lower guide posts, coordinated with the four lower guide sleeves and fixed to the lower part of the lower lifting plate; two servo electric cylinders VII, also fixed to the lower part of the lower fixing plate I, the output end thereof being hinged to the lower part of the lower lifting plate; the lower bearing seat I, fixed to the upper part of the lower lifting plate; the lower shaft I, mounted inside the lower bearing seat I through a bearing; the belt pulley I, fixed to the lower end of the lower shaft I; the lower servo motor I, fixed below the lower lifting plate through a transition flange, the output end thereof being fixedly provided with the belt pulley II; the belt pulley I and the belt pulley II being connected by the synchronous belt I; the lower fixing plate II, fixed to the top end of the lower shaft I; the lower sliding plate I, mounted above the lower fixing plate II through the lower guide rail I; the lower fixing plate III, fixed above the lower sliding plate I through the lower vertical plate I; the servo electric cylinder I, fixed to the left side of the upper part of the lower fixing plate II, the output end thereof being connected to the lower vertical plate I; left and right lower sliding plates II, mounted on the top end of the lower fixing plate III through the lower guide rails II; the lower servo motor II, fixed to the lower part of the lower fixing plate III, the output end thereof being fixedly provided with the lower gear; two lower racks, separately fixed to the lower sliding plates II and simultaneously meshed with the lower gear.

The lower brushing system includes: the lower fixing plate IV, fixed above the lower sliding plate II through the lower vertical plate II; the lower bearing seat II, fixed to the upper part of the lower fixing plate IV; the lower shaft II, mounted inside the lower bearing seat II through a bearing; the lower servo motor III, fixed to the lower part of the lower fixing plate IV, the output end thereof being connected to the lower side of the lower shaft II; the lower arm, the lower end thereof being fixed to the top end of the lower shaft II; the lower servo motor IV, fixed to the lower part of the lower arm, the output end thereof being fixedly provided with the belt pulley III; the lower arm, the upper part thereof being connected with the lower part of the upper arm by the rotating shaft II; the torsion spring, installed at a middle position of the lower arm and the upper arm; the belt pulley IV and the belt pulley V, fixed to the left side of the rotating shaft II, the belt pulley IV being located on the right side of the belt pulley V; the belt pulley III and the belt pulley IV being connected by the synchronous belt II; the belt pulley VI, mounted on the upper end of the upper arm via the rotating shaft I; the belt pulley V and the belt pulley VI being connected by the synchronous belt III; the lower vertical brush, fixed to the left side of the rotating shaft I; and the lower arm and the upper arm having brush hairs on sides thereof. The device includes two sets of left and right lower brushing systems.

The clamping and overturning system includes: the left sliding plate and the right sliding plate, mounted above the upper fixing plate I through the upper guide rail I; the upper gear, fixed at a middle position above the upper fixing plate I; the left sliding plate and the right sliding plate, the lower parts thereof being separately fixedly provided with the upper racks; two upper racks, simultaneously meshed with the upper gear; the upper cylinder, fixed above the upper fixing plate I, the output end thereof being connected with the left sliding plate; the left vertical plate, fixed above the left sliding plate; the left lifting arm, mounted on the right side of the left vertical plate through the upper guide rail II; the servo electric cylinder II, fixed to the lower part of the left vertical plate, the output end thereof being connected with the left lifting arm; the left bearing seat, fixed to the left side of the left lifting arm; the left shaft, mounted inside the left bearing seat through a bearing; the left clamping jaw, fixed to the right side of the left shaft; the right vertical plate, fixed to the top of the right sliding plate; the right lifting arm, mounted on the left side of the right vertical plate through the upper guide rail III; the servo electric cylinder III, fixed to the right vertical plate, the output end thereof being connected to the right lifting arm; the right bearing seat, fixed to the right side of the right lifting arm; the right shaft, mounted inside the right bearing seat through a bearing; the right clamping jaw, fixed to the left side of the right shaft; the upper servo motor I, fixed to the right side of the right bearing seat, the output end thereof being connected to the right side of the right shaft; and the servo electric cylinder VI, the cylinder body thereof being hinged to the frame and the output end thereof being hinged to the lower side of the upper fixing plate I.

The upper brushing system includes: the upper servo motor II, fixed to the upper part of the upper fixing plate II, the output end thereof being connected with the upper vertical brush; the upper bearing seat I, fixed below the upper rotating plate; the upper shaft I, mounted inside the upper bearing seat I through a bearing; the upper fixing plate II, fixed below the upper shaft I; the upper servo motor III, fixed to the lower part of the upper rotating plate, the output end thereof being connected to the upper end of the upper shaft I; the upper bearing seat III, fixed to the upper part of the upper rotating plate; the upper shaft III, mounted inside the upper bearing seat III through a bearing; the conical brush, fixed to the upper part of the upper bearing seat III; the upper servo motor V, fixed to the upper part of the upper rotating plate, the output end thereof being connected to the lower side of the upper shaft III; the upper bearing seat II, fixed to the right side of the upper vertical plate; the upper shaft II, mounted inside the upper bearing seat II through the bearing; the upper rotating plate, fixed to the right side of the upper shaft II; and the upper servo motor IV, fixed to the left side of the upper vertical plate, the output end thereof being connected to the left side of the upper shaft II.

The upper lifting system includes: four upper guide sleeves, fixed to the top end of the frame; four upper guide posts, coordinated with the four upper guide sleeves and fixed to the top end of the upper lifting plate; two servo electric cylinders IV, also fixed to the top of the frame, the output ends thereof being hinged to the upper part of the upper lifting plate; the upper sliding plate, mounted below the upper lifting plate through the upper guide rail IV; the servo electric cylinder V, fixed to the right side below the upper lifting plate, the output end thereof being connected with the upper sliding plate; and the upper vertical plate, fixed to the lower part of the upper sliding plate.

During operation, the upper cylinder enables the left clamping jaw and the right clamping jaw to center and clamp the wheel on the roller way through the upper gear, the upper racks and the upper guide rail I. The lower servo motor II adjusts the positions of the left and right lower arms through the lower gear, the lower racks and the lower guide rails II to adapt to the size of the center hole of the wheel. The lower servo motor I rotates the lower shaft I and the lower arms through the belt pulley I, the belt pulley II and the synchronous belt I. The servo electric cylinders VII lift the lower arms to the center hole of the wheel through the lower guide posts and the lower guide sleeves, and use the brush hairs on the sides of the lower arms to remove the burrs at the center hole of the wheel.

The lower servo motor IV rotates the belt pulley V through the belt pulley III, the belt pulley IV and the synchronous belt II. The belt pulley V rotates the belt pulley VI and the lower vertical brushes through the synchronous belt III. The lower servo motor III makes the postures of the two lower vertical brushes consistent through the lower shaft II. The servo electric cylinders VII lift the two rotated lower vertical brushes to the flange weight reducing socket position of the wheel through the lower guide posts and the lower guide sleeves. The torsion spring can be used to keep the lower vertical brushes and any position of the flange weight reducing socket contacted at all times. The servo electric cylinder I can realize the horizontal movement of the lower vertical brushes through the lower guide rail I, so that the lower vertical brushes can remove all burrs at the entire flange weight reducing socket.

The servo electric cylinder II and the servo electric cylinder III respectively lift the wheel to a certain height through the upper guide rail II and the upper guide rail III; the upper servo motor I overturns the clamped wheel by degrees through the right shaft, so that the back cavity faces upwardly. The upper servo motor II drives the upper vertical brush to rotate; the upper servo motor III can adjust the angle of the upper vertical brush in the vertical direction through the upper shaft I; the servo electric cylinder V can adjust the position of the upper vertical brush in the horizontal direction through the upper guide rail IV; the servo electric cylinder IV can realize the position of the upper vertical brush in the vertical direction through the upper guide posts and the upper guide sleeves; the servo electric cylinder VI can adjust the angle of the wheel so that the wheel back cavity is in a horizontal position, the own rotation of the upper vertical brush and the rotation of the upper vertical brush in the vertical direction are coordinated, so that the burrs on the edge of the wheel spoke weight reducing socket can be removed.

The upper servo motor V rotates the conical brush through the upper shaft III; the servo electric cylinder V can adjust the position of the conical brush in the horizontal direction through the upper guide rail IV; the servo electric cylinder IV can realize the position of the conical brush in the vertical direction by the upper guide posts and the upper guide sleeves; the upper servo motor IV makes positions of the upper vertical brush and the conical brush exchange through the upper shaft II, and can adjust the angle of the conical brush in the vertical direction, and the servo electric cylinder VI is coordinated to adjust the horizontal angle of the wheel back cavity, and the rotated conical brush can remove the burrs of the wheel spoke edge.

The present disclosure is capable of removing burrs at the center hole, the flange weight reducing socket, the spoke back cavity weight reducing socket and the spoke edge of the wheel during the use.

DETAILED DESCRIPTION

The following describes details and operation of a specific device provided by the present disclosure with reference to the accompanying drawings.

Figure 1:
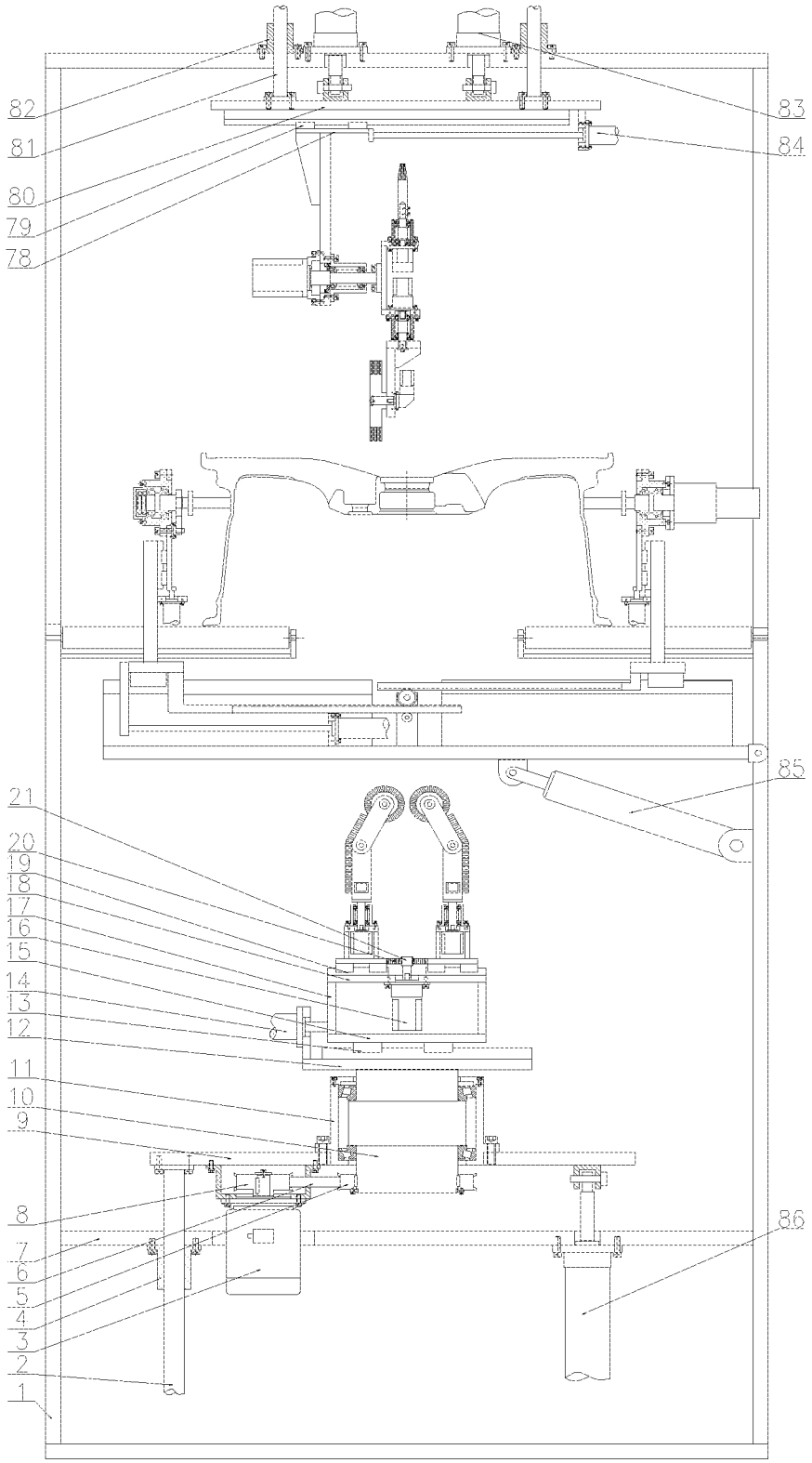
FIG. 1 is a front view of a multi-functional wheel deburring device of the present disclosure.
Figure 2:
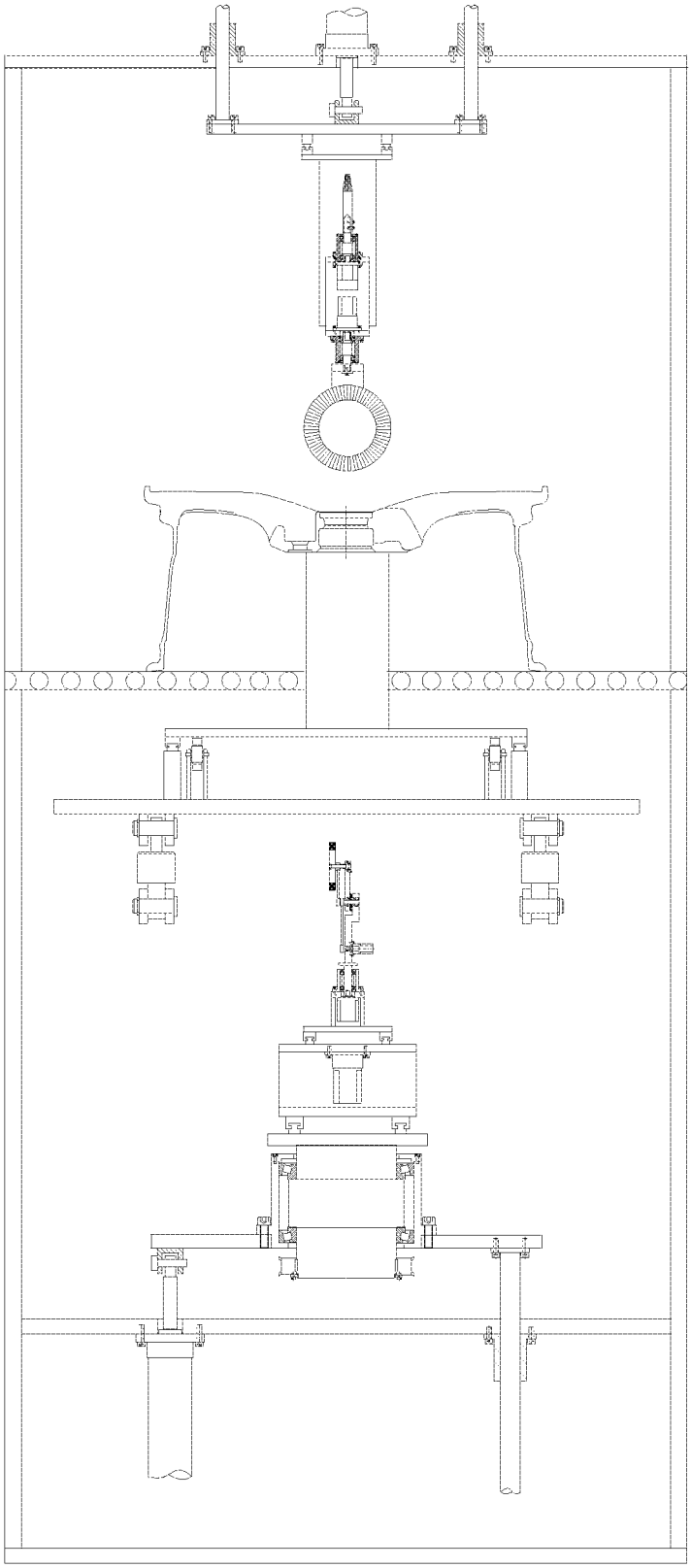
FIG. 2 is a left view of a multi-functional wheel deburring device of the present disclosure.
Figure 3:
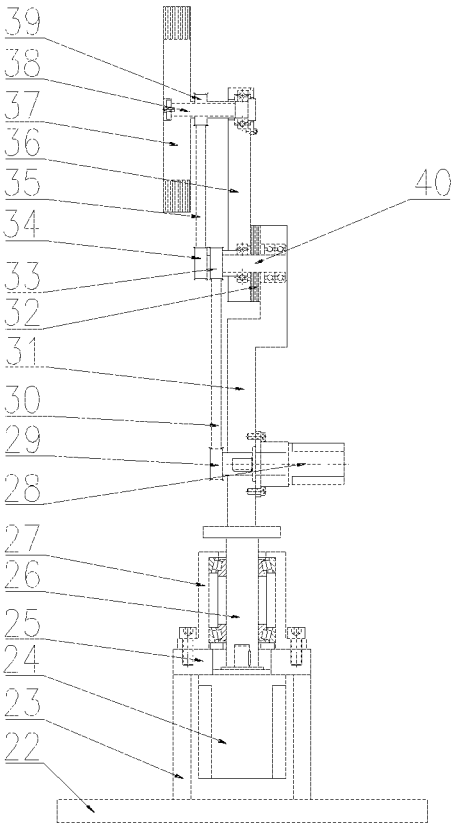
FIG. 3 is a front view of a lower brushing system of a multi-functional wheel deburring device of the present disclosure.
Figure 4:
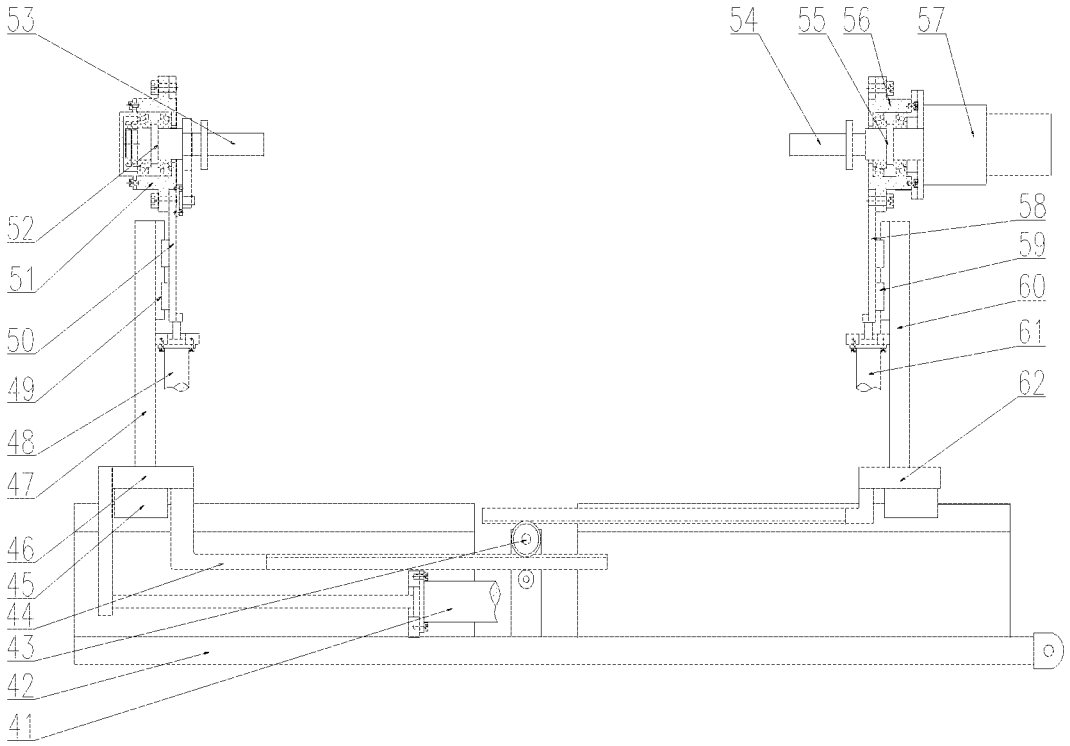
FIG. 4 is a front view of a clamping and overturning system of a multi-functional wheel deburring device of the present disclosure.
Figure 5:
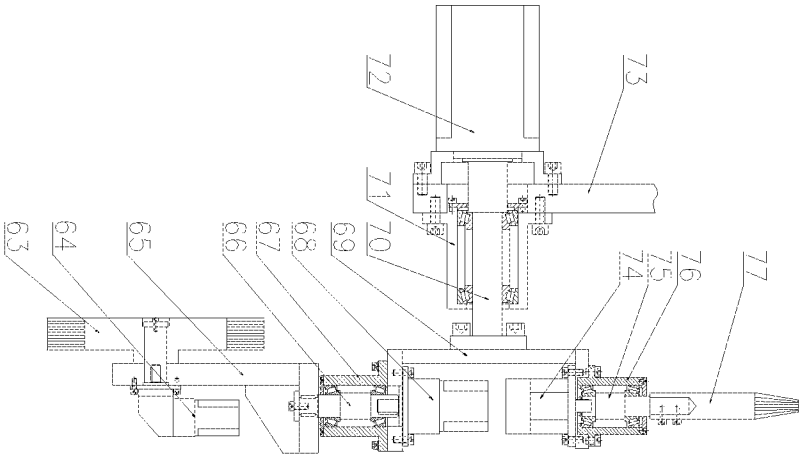
FIG. 5 is a front view of an upper brushing system of a multi-functional wheel deburring device of the present disclosure.

Referring to FIGS. 1-5, the device can comprise a frame 1, lower guide posts 2, a lower servo motor I 3, lower guide sleeves 4, a belt pulley I 5, a synchronous belt I 6, a lower fixing plate I 7, a belt pulley II 8, a lower lifting plate 9, a lower shaft I 10, a lower bearing seat I 11, a lower fixing plate II 12, a lower guide rail I 13, a servo electric cylinder I 14, a lower sliding plate I 15, a lower servo motor II 16, a lower vertical plate I 17, a lower fixing plate III 18, lower guide rails II 19, lower racks 20, a lower gear 21, lower sliding plates II 22, a lower vertical plate II 23, a lower servo motor III 24, a lower fixing plate IV 25, a lower shaft II 26, a lower bearing seat II 27, a lower servo motor IV 28, a belt pulley III 29, a synchronous belt II 30, lower arms 31, a torsion spring 32, a belt pulley IV 33, a belt pulley V 34, a synchronous belt III 35, upper arms 36, lower vertical brushes 37, a rotating shaft I 38, a belt pulley VI 39, a rotating shaft II 40, an upper cylinder 41, an upper fixing plate I 42, an upper gear 43, upper racks 44, an upper guide rail I 45, a left sliding plate 46, a left vertical plate 47, a servo electric cylinder II 48, an upper guide rail II 49, a left lifting arm 50, a left bearing seat 51, a left shaft 52, a left clamping jaw 53, a right clamping jaw 54, a right shaft 55, a right bearing seat 56, an upper servo motor I 57, a right lifting arm 58, an upper guide rail III 59, a right vertical plate 60, a servo electric cylinder III 61, a right sliding plate 62, an upper vertical brush 63, an upper servo motor II 64, an upper fixing plate II 65, an upper shaft I 66, an upper bearing seat I 67, an upper servo motor III 68, an upper rotating plate 69, an upper shaft II 70, an upper bearing seat II 71, an upper servo motor IV 72, an upper vertical plate 73, an upper servo motor V 74, an upper shaft III 75, an upper bearing seat III 76, a conical brush 77, an upper sliding plate 78, an upper guide rail IV 79, an upper lifting plate 80, an upper guide post 81, an upper guide sleeve 82, a servo electric cylinder IV 83, a servo electric cylinder V 84, a servo electric cylinder VI 85, and servo electric cylinders VII 86.

The lower lifting driving system includes: four lower guide sleeves 4, fixed to the lower part of the lower fixing plate I 7; four lower guide posts 2, coordinated with the four lower guide sleeves 4 and fixed to the lower part of the lower lifting plate 9; two servo electric cylinders VII 86, also fixed to the lower part of the lower fixing plate I 7, the output end thereof being hinged to the lower part of the lower lifting plate 9; the lower bearing seat I 11, fixed to the upper part of the lower lifting plate 9; the lower shaft I 10, mounted inside the lower bearing seat I 11 through a bearing; the belt pulley I 5, fixed to the lower end of the lower shaft I 10; the lower servo motor I 3, fixed below the lower lifting plate 9 through a transition flange, the output end thereof being fixedly provided with the belt pulley II 8; the belt pulley I 5 and the belt pulley II 8 being connected by the synchronous belt I 6; the lower fixing plate II 12, fixed to the top end of the lower shaft I 10; the lower sliding plate I 15, mounted above the lower fixing plate II 12 through the lower guide rail I 13; the lower fixing plate III 18, fixed above the lower sliding plate I 15 through the lower vertical plate I 17; the servo electric cylinder I 14, fixed to the left side of the upper part of the lower fixing plate II 12, the output end thereof being connected to the lower vertical plate I 17; left and right lower sliding plates II 22, mounted on the top end of the lower fixing plate III 18 through the lower guide rails II 19; the lower servo motor II 16, fixed to the lower part of the lower fixing plate III 18, the output end thereof being fixedly provided with the lower gear 21; two lower racks 20, separately fixed to the lower sliding plates II 22 and simultaneously meshed with the lower gear 21.

The lower brushing system includes: the lower fixing plate IV 25, fixed above the lower sliding plate II 22 through the lower vertical plate II 23; the lower bearing seat II 27, fixed to the upper part of the lower fixing plate IV 25; the lower shaft II 26, mounted inside the lower bearing seat II 27 through a bearing; the lower servo motor III 24, fixed to the lower part of the lower fixing plate IV 25, the output end thereof being connected to the lower side of the lower shaft II 26; the lower arm 31, the lower end thereof being fixed to the top end of the lower shaft II 26; the lower servo motor IV 28, fixed to the lower part of the lower arm 31, the output end thereof being fixedly provided with the belt pulley III 29; the lower arm 31, the upper part thereof being connected with the lower part of the upper arm 36 by the rotating shaft II 40; the torsion spring 32, installed at a middle position of the lower arm 31 and the upper arm 36; the belt pulley IV 33 and the belt pulley V34, fixed to the left side of the rotating shaft II 40, the belt pulley IV 33 being located on the right side of the belt pulley V34; the belt pulley III 29 and the belt pulley IV 33 being connected by the synchronous belt II 30; the belt pulley VI 39, mounted on the upper end of the upper arm 36 via the rotating shaft I 38; the belt pulley V 34 and the belt pulley VI 39 being connected by the synchronous belt III 35; the lower vertical brush 37, fixed to the left side of the rotating shaft I 38; and the lower arm 31 and the upper arm 36 having brush hairs on sides thereof. The device includes two sets of left and right lower brushing systems.

The clamping and overturning system includes: the left sliding plate 46 and the right sliding plate 62, mounted above the upper fixing plate I 42 through the upper guide rail I 45; the upper gear 43, fixed at a middle position above the upper fixing plate I 42; the left sliding plate 46 and the right sliding plate 62, the lower parts thereof being separately fixedly provided with the upper racks 44; two upper racks 44, simultaneously meshed with the upper gear 43; the upper cylinder 41, fixed above the upper fixing plate I 42, the output end thereof being connected with the left sliding plate 46; the left vertical plate 47, fixed above the left sliding plate 46; the left lifting arm 50, mounted on the right side of the left vertical plate 47 through the upper guide rail II 49; the servo electric cylinder II 48, fixed to the lower part of the left vertical plate 47, the output end thereof being connected with the left lifting arm 50; the left bearing seat 51, fixed to the left side of the left lifting arm 50; the left shaft 52, mounted inside the left bearing seat 51 through a bearing; the left clamping jaw 53, fixed to the right side of the left shaft 52; the right vertical plate 60, fixed to the top of the right sliding plate 62; the right lifting arm 58, mounted on the left side of the right vertical plate 60 through the upper guide rail III 59; the servo electric cylinder III 61, fixed to the right vertical plate 60, the output end thereof being connected to the right lifting arm 58; the right bearing seat 56, fixed to the right side of the right lifting arm 58; the right shaft 55, mounted inside the right bearing seat 56 through a bearing; the right clamping jaw 54, fixed to the left side of the right shaft 55; the upper servo motor I 57, fixed to the right side of the right bearing seat 56, the output end thereof being connected to the right side of the right shaft 55; and the servo electric cylinder VI 85, the cylinder body thereof being hinged to the frame 1 and the output end thereof being hinged to the lower side of the upper fixing plate I 42.

The upper brushing system includes: the upper servo motor II 64, fixed to the upper part of the upper fixing plate II 65, the output end thereof being connected with the upper vertical brush 63; the upper bearing seat I 67, fixed below the upper rotating plate 69; the upper shaft I 66, mounted inside the upper bearing seat I 67 through a bearing; the upper fixing plate II 65, fixed below the upper shaft I 66; the upper servo motor III 68, fixed to the lower part of the upper rotating plate 69, the output end thereof being connected to the upper end of the upper shaft I 66; the upper bearing seat III 76, fixed to the upper part of the upper rotating plate 69; the upper shaft III 75, mounted inside the upper bearing seat III 76 through a bearing; the conical brush 77, fixed to the upper part of the upper bearing seat III 76; the upper servo motor V74, fixed to the upper part of the upper rotating plate 69, the output end thereof being connected to the lower side of the upper shaft III 75; the upper bearing seat II 71, fixed to the right side of the upper vertical plate 73; the upper shaft II 70, mounted inside the upper bearing seat II 71 through the bearing; the upper rotating plate 69, fixed to the right side of the upper shaft II 70; and the upper servo motor IV 72, fixed to the left side of the upper vertical plate 73, the output end thereof being connected to the left side of the upper shaft II 70.

The upper lifting system includes: four upper guide sleeves 82, fixed to the top end of the frame 1; four upper guide posts 81, coordinated with the four upper guide sleeves 82 and fixed to the top end of the upper lifting plate 80; two servo electric cylinders IV 83, also fixed to the top of the frame 1, the output ends thereof being hinged to the upper part of the upper lifting plate 80; the upper sliding plate 78, mounted below the upper lifting plate 80 through the upper guide rail IV 79; the servo electric cylinder V 84, fixed to the right side below the upper lifting plate 80, the output end thereof being connected with the upper sliding plate 78; and the upper vertical plate 73, fixed to the lower part of the upper sliding plate 78.

During operation, the upper cylinder 41 enables the left clamping jaw 53 and the right clamping jaw 54 to center and clamp the wheel on the roller way through the upper gear 43, the upper racks 44 and the upper guide rail I 45. The lower servo motor II 16 adjusts the positions of the left and right lower arms 31 through the lower gear 21, the lower racks 20 and the lower guide rails II 19 to adapt to the size of the center hole of the wheel. The lower servo motor I 3 rotates the lower shaft I 10 and the lower arms 31 through the belt pulley I 5, the belt pulley II 8 and the synchronous belt I 6. The servo electric cylinders VII 86 lift the lower arms 31 to the center hole of the wheel through the lower guide posts 2 and the lower guide sleeves 4, and use the brush hairs on the sides of the lower arms 31 to remove the burrs at the center hole of the wheel.

The lower servo motor IV 28 rotates the belt pulley V 34 through the belt pulley III 29, the belt pulley IV 33 and the synchronous belt II 30. The belt pulley V 34 rotates the belt pulley VI 39 and the lower vertical brushes 37 through the synchronous belt III 35. The lower servo motor III 24 makes the postures of the two lower vertical brushes 37 consistent through the lower shaft II 26. The servo electric cylinders VII 86 lift the two rotated lower vertical brushes 37 to the flange weight reducing socket position of the wheel through the lower guide posts 2 and the lower guide sleeves 4. The torsion spring 32 can be used to keep the lower vertical brushes 37 and any position of the flange weight reducing socket contacted at all times. The servo electric cylinder I 14 can realize the horizontal movement of the lower vertical brushes 37 through the lower guide rail I 13, so that the lower vertical brushes 37 can remove all burrs at the entire flange weight reducing socket.

The servo electric cylinder II 48 and the servo electric cylinder III 61 respectively lift the wheel to a certain height through the upper guide rail II 49 and the upper guide rail III 59; the upper servo motor I 57 overturns the clamped wheel by 180 degrees through the right shaft 55, so that the back cavity faces upwardly. The upper servo motor II 64 drives the upper vertical brush 63 to rotate; the upper servo motor III 68 can adjust the angle of the upper vertical brush 63 in the vertical direction through the upper shaft I 66; the servo electric cylinder V 84 can adjust the position of the upper vertical brush 63 in the horizontal direction through the upper guide rail IV 79; the servo electric cylinder IV 83 can realize the position of the upper vertical brush 63 in the vertical direction through the upper guide posts 81 and the upper guide sleeves 82; the servo electric cylinder VI 85 can adjust the angle of the wheel so that the wheel back cavity is in a horizontal position, the own rotation of the upper vertical brush 63 and the rotation of the upper vertical brush 63 in the vertical direction are coordinated, so that the burrs on the edge of the wheel spoke weight reducing socket can be removed.

The upper servo motor V 74 rotates the conical brush 77 through the upper shaft III 75; the servo electric cylinder V 84 can adjust the position of the conical brush 77 in the horizontal direction through the upper guide rail IV 79; the servo electric cylinder IV 83 can realize the position of the conical brush 77 in the vertical direction by the upper guide posts 81 and the upper guide sleeves 82; the upper servo motor IV 72 makes positions of the upper vertical brush 63 and the conical brush 77 exchange through the upper shaft II 70, and can adjust the angle of the conical brush 77 in the vertical direction, and the servo electric cylinder VI 85 is coordinated to adjust the horizontal angle of the wheel back cavity, and the rotated conical brush 77 can remove the burrs of the wheel spoke edge.

The invention claimed is:

1. A multi-functional wheel deburring device, comprising: a lower lifting driving system, a lower brushing system, a clamping and overturning system, an upper brushing system, an upper lifting system, a frame, four lower guide posts, a lower servo motor I, four lower guide sleeves, a belt pulley I, a synchronous belt I, a lower fixing plate I, a belt pulley II, a lower lifting plate, a lower shaft I, a lower bearing seat I, a lower fixing plate II, a lower guide rail I, a servo electric cylinder I, a lower sliding plate I, a lower servo motor II, a lower vertical plate I, a lower fixing plate III, lower guide rails II, two lower racks, a lower gear, left and right lower sliding plates II, a lower vertical plate II, a lower servo motor III, a lower fixing plate IV, a lower shaft II, a lower bearing seat II, a lower servo motor IV, a belt pulley III, a synchronous belt II, lower arms, a torsion spring, a belt pulley IV, a belt pulley V, a synchronous belt III, upper arms, lower vertical brushes, a rotating shaft I, a belt pulley VI, a rotating shaft II, an upper cylinder, an upper fixing plate I, an upper gear, two upper racks, an upper guide rail I, a left sliding plate, a left vertical plate, a servo electric cylinder II, an upper guide rail II, a left lifting arm, a left bearing seat, a left shaft, a left clamping jaw, a right clamping jaw, a right shaft, a right bearing seat, an upper servo motor I, a right lifting arm, an upper guide rail III, a right vertical plate, a servo electric cylinder III, a right sliding plate, an upper vertical brush, an upper servo motor II, an upper fixing plate II, an upper shaft I, an upper bearing seat I, an upper servo motor III, an upper rotating plate, an upper shaft II, an upper bearing seat II, an upper servo motor IV, an upper vertical plate, an upper servo motor V, an upper shaft III, an upper bearing seat III, a conical brush, an upper sliding plate, an upper guide rail IV, an upper lifting plate, four upper guide posts four upper guide sleeves, two servo electric cylinders IV, a servo electric cylinder V, a servo electric cylinder VI, and two servo electric cylinders VII, wherein, the lower lifting driving system comprises:

the four lower guide sleeves, fixed to the lower part of the lower fixing plate I;

the four lower guide posts each of the four lower guide posts respectively corresponding with each one of the four lower guide sleeves and fixed to the lower part of the lower lifting plate;

the two servo electric cylinders VII, fixed to the lower part of the lower fixing plate I, the output end thereof being hinged to the lower part of the lower lifting plate;

the lower bearing seat I, fixed to the upper part of the lower lifting plate;

the lower shaft I, mounted inside the lower bearing seat I through a bearing;

the belt pulley I, fixed to the lower end of the lower shaft I;

the lower servo motor I, fixed below the lower lifting plate through a transition flange, the output end thereof being fixedly provided with the belt pulley II;

the belt pulley I and the belt pulley II being connected by the synchronous belt I;

the lower fixing plate II, fixed to the top end of the lower shaft I;

the lower sliding plate I, mounted above the lower fixing plate II through the lower guide rail I;

the lower fixing plate III, fixed above the lower sliding plate I through the lower vertical plate I;

the servo electric cylinder I, fixed to the left side of the upper part of the lower fixing plate II, the output end thereof being connected to the lower vertical plate I;

the left and right lower sliding plates II, mounted on the top end of the lower fixing plate III through the lower guide rails II;

the lower servo motor II, fixed to the lower part of the lower fixing plate III, the output end thereof being fixedly provided with the lower gear;

the two lower racks, each of the two lower racks separately fixed to one of the left and right lower sliding plates II and simultaneously meshed with the lower gear;

the lower brushing system comprises:

the lower fixing plate IV, fixed above the lower sliding plate II through the lower vertical plate II;

the lower bearing seat II, fixed to the upper part of the lower fixing plate IV;

the lower shaft II, mounted inside the lower bearing seat II through a bearing;

the lower servo motor III, fixed to the lower part of the lower fixing plate IV, the output end thereof being connected to the lower side of the lower shaft II;

the lower arm, the lower end thereof being fixed to the top end of the lower shaft II;

the lower servo motor IV, fixed to the lower part of the lower arm, the output end thereof being fixedly provided with the belt pulley III;

the lower arm, the upper part thereof being connected with the lower part of the upper arm by the rotating shaft II;

the torsion spring, installed at a middle position of the lower arm and the upper arm;

the belt pulley IV and the belt pulley V, fixed to the left side of the rotating shaft II, the belt pulley IV being located on the right side of the belt pulley V;

the belt pulley III and the belt pulley IV being connected by the synchronous belt II;

the belt pulley VI, mounted on the upper end of the upper arm via the rotating shaft I;

the belt pulley V and the belt pulley VI being connected by the synchronous belt III;

the lower vertical brush, fixed to the left side of the rotating shaft I; and the lower arm and the upper arm having brush hairs on sides thereof;

the device comprises two sets of left and right lower brushing systems;

the clamping and overturning system comprises:

the left sliding plate and the right sliding plate, mounted above the upper fixing plate I through the upper guide rail I;

the upper gear, fixed at a middle position above the upper fixing plate I;

the left sliding plate and the right sliding plate, the lower parts thereof being separately fixedly provided with the two upper racks;

the two upper racks, simultaneously meshed with the upper gear;

the upper cylinder, fixed above the upper fixing plate I, the output end thereof being connected with the left sliding plate;

the left vertical plate, fixed above the left sliding plate;

the left lifting arm, mounted on the right side of the left vertical plate through the upper guide rail II;

the servo electric cylinder II, fixed to the lower part of the left vertical plate, the output end thereof being connected with the left lifting arm;

the left bearing seat, fixed to the left side of the left lifting arm;

the left shaft, mounted inside the left bearing seat through a bearing;

the left clamping jaw, fixed to the right side of the left shaft;

the right vertical plate, fixed to the top of the right sliding plate;

the right lifting arm, mounted on the left side of the right vertical plate through the upper guide rail III;

the servo electric cylinder III, fixed to the right vertical plate, the output end thereof being connected to the right lifting arm;

the right bearing seat, fixed to the right side of the right lifting arm;

the right shaft, mounted inside the right bearing seat through a bearing;

the right clamping jaw, fixed to the left side of the right shaft;

the upper servo motor I, fixed to the right side of the right bearing seat, the output end thereof being connected to the right side of the right shaft; and the servo electric cylinder VI, the servo electric cylinder VI comprising a body thereof hingedly connected to the frame and the output end thereof being hinged to the lower side of the upper fixing plate I;

the upper brushing system comprises:

the upper servo motor II, fixed to the upper part of the upper fixing plate II, the output end thereof being connected with the upper vertical brush;

the upper bearing seat I, fixed below the upper rotating plate;

the upper shaft I, mounted inside the upper bearing seat I through a bearing;

the upper fixing plate II, fixed below the upper shaft I;

the upper servo motor III, fixed to the lower part of the upper rotating plate, the output end thereof being connected to the upper end of the upper shaft I;

the upper bearing seat III, fixed to the upper part of the upper rotating plate;

the upper shaft III, mounted inside the upper bearing seat III through a bearing;

the conical brush, fixed to the upper part of the upper bearing seat III;

the upper servo motor V, fixed to the upper part of the upper rotating plate, the output end thereof being connected to the lower side of the upper shaft III;

the upper bearing seat II, fixed to the right side of the upper vertical plate;

the upper shaft II, mounted inside the upper bearing seat II through the bearing;

the upper rotating plate, fixed to the right side of the upper shaft II; and the upper servo motor IV, fixed to the left side of the upper vertical plate, the output end thereof being connected to the left side of the upper shaft II;

the upper lifting system comprises:

the four upper guide sleeves, fixed to the top end of the frame;

the four upper guide posts, each of the four upper guide posts respectively corresponding with each one of the four upper guide sleeves and fixed to the top end of the upper lifting plate;

the two servo electric cylinders IV, fixed to the top of the frame, the output ends thereof being hinged to the upper part of the upper lifting plate;

the upper sliding plate, mounted below the upper lifting plate through the upper guide rail IV;

the servo electric cylinder V, fixed to the right side below the upper lifting plate, the output end thereof being connected with the upper sliding plate; and the upper vertical plate, fixed to the lower part of the upper sliding plate.

* * * * *